US006013852A

United States Patent [19]

Chandrasekharan et al.

[11] Patent Number: 6,013,852

[45] Date of Patent: Jan. 11, 2000

[54] PRODUCING LIGHT OLEFINS FROM A CONTAMINATED LIQUID HYDROCARBON STREAM BY MEANS OF THERMAL CRACKING

[75] Inventors: Krishnamoorthy Chandrasekharan, The Hague; Robert Paul Henri Cossee; Jan Lodewijk Maria Dierickx, both of CM Amsterdam, all of Netherlands

[73] Assignee: Shell Oil Company, Houston, Tex.

[21] Appl. No.: 09/176,080

[22] Filed: Oct. 20, 1998

[30] Foreign Application Priority Data

Nov. 21, 1997 [EP] European Pat. Off. ..... 97203655

[51] Int. Cl.[7] ..... C07C 4/02; C07C 7/144; C10G 17/00

[52] U.S. Cl. ..... 585/648; 585/818; 585/819; 208/88

[58] Field of Search ..... 585/648, 818, 585/819; 208/88

[56] References Cited

U.S. PATENT DOCUMENTS

| | | | |
|---|---|---|---|
| 3,862,898 | 1/1975 | Boyd et al. | 208/72 |
| 4,072,488 | 2/1978 | Perciful | 208/102 |
| 4,797,200 | 1/1989 | Osterhuber | 208/308 |
| 4,962,270 | 10/1990 | Feimer et al. | 585/819 |
| 5,254,795 | 10/1993 | Boucher et al. | 585/819 |
| 5,538,625 | 7/1996 | Sigaud et al. | 208/127 |

*Primary Examiner*—Walter D. Griffin
*Assistant Examiner*—In Suk Bullock

[57] ABSTRACT

Producing light olefins from a contaminated liquid hydrocarbon feed by means of thermal cracking of, which process comprises the steps of supplying the feed (6) to the inlet (7) of a membrane unit (1) provided with a polysiloxane membrane (10), and removing from the permeate side (9) a permeate (14) and from the retentate side (8) a retentate (12); supplying the permeate (14) to the inlet of a cracking furnace (2), allowing the permeate to crack in the coils (15, 16) of the cracking furnace (2) in the presence of steam (17) at elevated temperature and removing from the cracking furnace (2) a cracked stream (19) which is enriched in light olefins; quenching (22, 24) the cracked stream; supplying the cooled cracked stream to a fractionation column (3); supplying the retentate (12) to the fractionation column (3); and removing from the fractionation column (3); a gaseous stream (30), a side stream of fuel oil components (45) and a bottom stream (50).

1 Claim, 1 Drawing Sheet

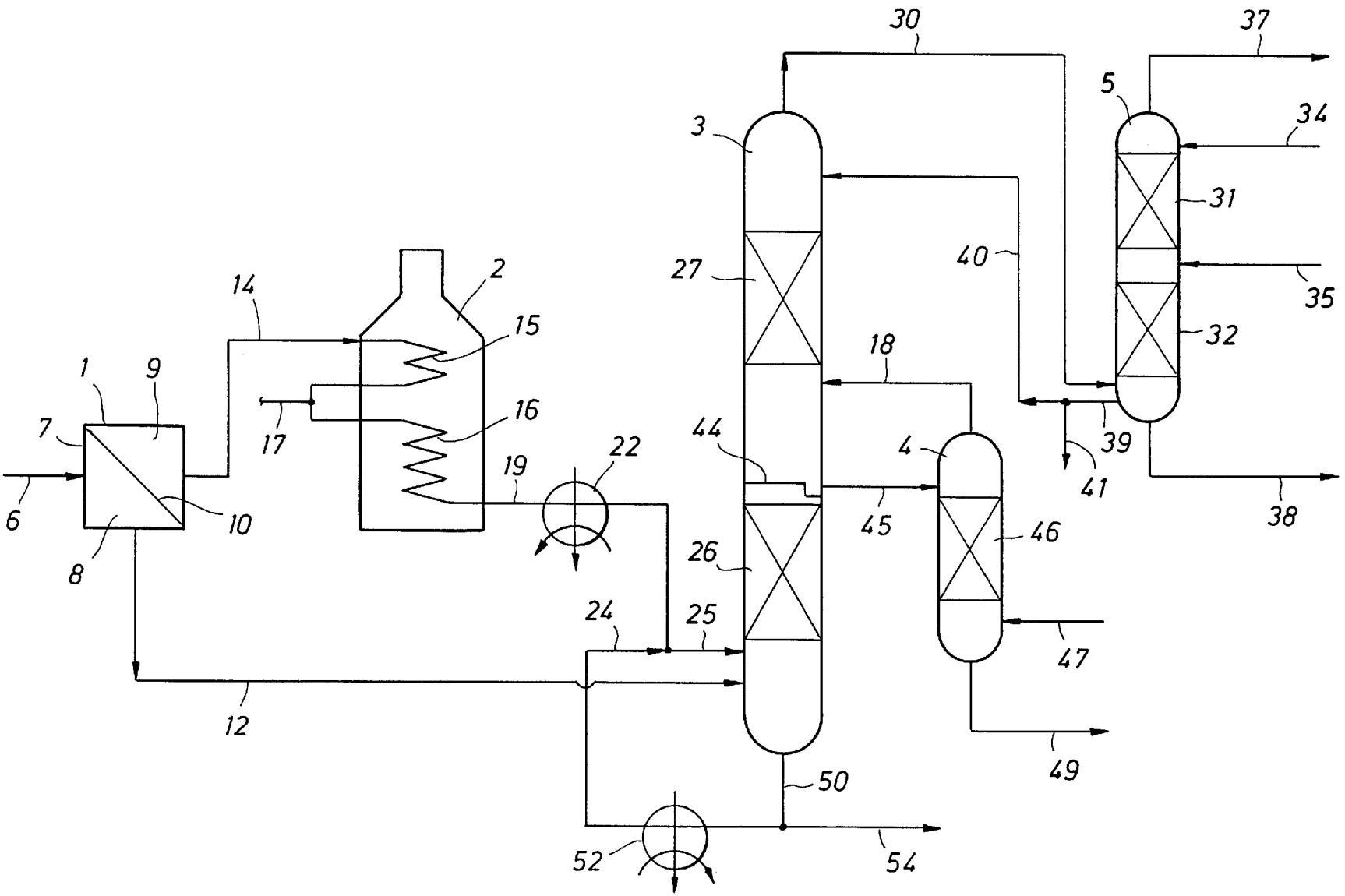
37
34
35
38
31
32
5
39
41
30
40
46
47
49
4
18
45
54
50
3
27
44
26
25
22
24
52
2
15
16
19
17
14
10
12
9
1
8
7
6

PRODUCING LIGHT OLEFINS FROM A CONTAMINATED LIQUID HYDROCARBON STREAM BY MEANS OF THERMAL CRACKING

1. FIELD OF THE INVENTION

The present invention relates to a process of producing light olefins from a liquid hydrocarbon feed containing naphtha and/or gas oil by means of thermal cracking.

2. BACKGROUND OF THE INVENTION

A thermal cracking process comprises the steps of (a) supplying the feed to the inlet of a cracking furnace, allowing the feed to crack in the coils of the cracking furnace in the presence of steam at elevated temperature and removing from the cracking furnace a cracked stream which is enriched in light olefins;

(b) quenching the cracked stream;

(c) supplying the cooled cracked stream to a fractionation column; and (d) removing from the top of the fractionation column a gaseous stream, from the side of the fractionation column a side stream containing fuel oil components and from the bottom of the fractionation column a bottom stream.

This process is also called steam cracking, naphtha cracking or ethylene manufacturing.

The fractionation column is also called 'primary fractionator'.

The gaseous stream removed from the top of the fractionation column comprises light olefins, such as ethylene and propylene, and other components, such as hydrogen, methane, $C_4$ products and pyrolysis gasoline ($C_5^+$). Downstream of the fractionation column, the gaseous overhead is further treated to recover ethylene.

From the side of the fractionation column one or more side stream(s) is (are) removed which contains fuel oil components.

From the bottom of the fractionation column is removed a liquid bottom stream which contains heavy cracked fuel oil. Part of the liquid bottom stream is cooled and mixed with the cracked stream upstream of the fractionation column to quench this stream. The remainder is removed as heavy fuel oil.

Upstream of the fractionation column the feed is cracked in the cracking furnace. The liquid hydrocarbon feed is preheated upstream of the cracking furnace or inside the upper part of the cracking furnace. In the cracking furnace the liquid hydrocarbon stream is first vaporized and subsequently cracked. Vaporization of the liquid hydrocarbon stream takes place in the presence of steam in a vaporization coil located in the upper part of the cracking furnace, where the liquid is vaporized by the heat from the hot flue gas. The upper part of the cracking furnace is called the convection section. After the stream is vaporized, it enters into the pyrolysis coil in the radiant section of the cracking furnace. In the pyrolysis coil hydrocarbons are cracked in the presence of steam to obtain the desired product. This is well known, and the conditions for vaporization and cracking are well known as well.

Feeds that are used are naphtha (a straight-run gasoline fraction) and gas oil (a distillate, intermediate in character between kerosene and light lubricating oils). Such feeds, however, tend to become more expensive, and this triggers the interest in using other hydrocarbon feeds for the cracking process. Examples of such feeds are certain condensates which comprise naphtha and gas oil components. Condensate is a mixture of hydrocarbons which are sometimes produced with natural gas.

These feeds, however, also contain contaminants. In relation to the present invention two contaminants are of particular interest. On the one hand hydrocarbons with a high boiling point and on the other hand salts present in water droplets which are dispersed in the stream of light hydrocarbons.

Hydrocarbons with a high boiling points are hydrocarbons which do not easily vaporize, even in the presence of steam. Examples of such hydrocarbons are polynuclear aromatics, polynuclear cycloparaffins, large paraffinic hydrocarbons (waxes), and olefinic components such as polynuclear cycloolefins and large olefinic hydrocarbons specially diolefins. These high boiling point hydrocarbons are soluble in the light hydrocarbons, and the solution usually has a darker colour for example an ASTM colour of 3 or more, determined in accordance with ASTM D1500. An example of a contaminated liquid stream containing light hydrocarbons is a black condensate, which is a mixture of hydrocarbons which are sometimes produced with natural gas having an ASTM colour of 3 or more. The contaminated liquid may also include waste streams for the refinery.

The salts in the hydrocarbon streams will come from formation water or from other treatments at a refinery, examples of contaminating salts are sodium chloride, magnesium chloride, calcium chloride and iron chloride. Other salts, such as sulphates may be present as well.

These components will remain liquid in the vaporization coil and will foul the inner surface of the vaporization coil. Fouling by deposited components will reduce the heat transfer and will consequently adversely affect the performance of a steam cracker. Moreover, fouling can even cause plugging of the vaporization coil.

It is an object of the present invention to provide a process of producing light olefins in particular from contaminated feeds, wherein fouling of the vaporization coil is reduced.

3. SUMMARY OF THE INVENTION

To this end the process of producing light olefins from a contaminated liquid hydrocarbon feed by means of thermal cracking according to the present invention comprises the steps of (a) supplying the feed to the inlet of a membrane unit provided with a membrane, and removing from the permeate side a permeate and from the retentate side a retentate;

(b) supplying the permeate to the inlet of a cracking furnace, allowing the permeate to crack in the coils of the cracking furnace in the presence of steam at elevated temperature and removing from the cracking furnace a cracked stream which is enriched in light olefins;

(c) quenching the cracked stream;

(d) supplying the cooled cracked stream to a fractionation column;

(e) supplying the retentate to the fractionation column; and (f) removing from the top of the fractionation column a gaseous stream, from the side of the fractionation column a side stream of fuel oil components and from the bottom of the fractionation column a bottom stream.

In case the contaminant comprises hydrocarbons with a high boiling point, the membrane is a nanofiltration membrane, if the contaminant is a salt, the membrane is an ultrafiltration membrane, and if both contaminants are present, the membrane is a nanofiltration membrane.

4. BRIEF DESCRIPTION OF THE DRAWING

FIG. 1 is schematic representation of a plant for thermal cracking to produce light olefins.

5. DETAILED DESCRIPTION OF THE INVENTION

The invention will now be described by way of example in more detail with reference to the accompanying drawing showing schematically the plant for carrying out the present invention.

The plant comprises a membrane unit 1, a cracking furnace 2, a fractionation column 3, a fuel oil stripper 4 and a quench tower 5.

The contaminated liquid hydrocarbon feed is supplied through supply conduit 6 to the inlet 7 of the membrane unit 1. The membrane unit 1 comprises a retentate side 8 and a permeate side 9 separated by means of a suitable membrane 10.

From the retentate side 8 a retentate is removed through conduit 12, and from the permeate side 9 a permeate is removed through conduit 14. The permeate is substantially free from contaminants, and the removed contaminants are in the retentate.

The permeate forms the feed to the cracking furnace 2. Optionally the feed is preheated upstream of the cracking furnace 2. In the cracking furnace 2 the feed is first vaporized in a vaporization coil 15 in the upper part of the cracking furnace 2. Downstream of the vaporization coil 15, the vaporized stream is cracked in a pyrolysis coil 16 in the lower part of the cracking furnace 2, where heating is done by means of radiation. In the pyrolysis coil 16 the stream is cracked in the presence of steam supplied through conduit 17 to obtain the desired product, a cracked stream which is enriched in light olefins. The conditions of cracking the permeate are similar to the well-known conditions for cracking naphtha or gas oil.

The cracked stream is removed from the cracking furnace 2 through conduit 19. The cracked stream is quenched by indirect heat exchange with steam in heat exchanger 22 and by direct heat exchange with a liquid supplied through conduit 24. The mixture including the cracked stream is passed through conduit 25 to the fractionation column 3.

The cooled cracked stream is introduced at a temperature of between 200 and 230° C. and at a pressure of between 0.11 and 0.25 MPa (absolute) in the fractionation column 3, where it is separated into fractions. To this end the fractionation column 3 comprises several theoretical fractionation stages 26 and 27.

The retentate is passed through conduit 12 to the fractionation column 3, and introduced in it at a level which is suitably near the level at which the mixture including the cracked stream is introduced into the fractionation column 3 through conduit 25.

From the top of the fractionation column 3 is removed a gaseous stream through conduit 30. The gaseous stream is rich in light olefins, such as ethylene and propylene, and comprises other components such as hydrogen, methane, $C_4$ products and pyrolysis gasoline ($C_5$+). The gaseous stream is passed through conduit 30 to the quench tower 5 which comprises several theoretical fractionation stages 31 and 32. In the quench tower 5, the gaseous stream comprising cracked gas is cooled and pyrolysis gasoline components are removed, moreover, dilution steam is condensed. To this end cooling water is supplied to the quench tower through conduits 34 and 35. Through conduit 37 a gaseous overhead is removed from the quench tower 5, which gaseous overhead is further treated (not shown) to recover ethylene. From the bottom of the quench tower 5 a water-rich stream is removed through conduit 38, and from the lower end of the quench tower 5 a gasoline stream is removed through conduit 39. Part of the gasoline stream is supplied through conduit 40 to the upper end of the fractionation column 3 as reflux, and the remainder is removed through conduit 41.

From the side of the fractionation column 3 a side stream is removed which contains fuel oil components via draw-off tray 44. This stream is passed through conduit 45 to the fuel oil stripper 4. The fuel oil stripper 4 is provided with theoretical fractionation stages 46. Through conduit 47 stripping steam is supplied to the lower end of the fuel oil stripper 4. From the top of the fuel oil stripper 4 is removed a gaseous overhead stream which is passed through conduit 48 into the fractionation column 3, and from the bottom is removed fuel oil product through conduit 49.

From the bottom of the fractionation column 3 is removed a liquid bottom stream which contains heavy cracked fuel oil through conduit 50. Part of the liquid bottom stream is cooled by indirect heat exchange in heat exchanger 52 and supplied via conduit 24 to the cracked stream which is enriched in light olefins in conduit 19 to quench this stream. The remainder is removed as heavy fuel oil through conduit 54. Optionally the heavy fuel oil is stripped by means of steam in a separate stripper vessel (not shown) and the stripped vapours are introduced in the lower part of the fractionation column 3.

The membrane separation is carried out at a temperature in the range of from 10 to 100° C. and suitably at 40° C., and the mass ratio between permeate and retentate is between 1 and 20 and suitably between 5 and 10.

In case the membrane separation is carried out at a lower temperature than the temperature prevailing in the fractionation column 3, the retentate supplied through conduit 12 will have a lower temperature than the temperature in the fractionation column 3. If it is envisaged that this temperature difference could adversely affect the fractionation, a heat exchanger (not shown) could be included in conduit 12 to heat, during normal operation, the retentate passing through it.

Where the contaminants comprise hydrocarbons with a high boiling point, the membrane suitably used in the membrane unit 1 is a nanofiltration membrane. A suitable material for such a nanofiltration membrane is a polysiloxane and suitably a poly(di-methyl siloxane). The nanofiltration membrane is operated with a trans-membrane pressure of between 1 and 8 MPa and a flux of between 1,000 and 4,000 kg/m$^2$ membrane area per day.

Where the contaminant is a salt an ultrafiltration membrane is used. Suitable ultrafiltration membrane materials are polytetrafluoroethylene (PTFE) and poly(vinylidene fluoride) (PVDF), in addition also ceramic membranes can be used. The ultrafiltration membrane is operated with a trans-membrane pressure of between 0.2 and 1 MPa and a flux of between 3,000 and 20,000 kg/m$^2$ membrane area per day.

The nanofiltration membrane is used as well where both contaminants are present.

A first advantage of the present invention is that it offers the possibility of cracking feeds which would normally cause fouling.

The retentate which contains an increased concentration of contaminants is supplied to the fractionation column. This is advantageous because the lighter components which are present in the retentate will be separated in the fractionation column and they will leave the fractionation column with the pyrolysis gasoline and/or with the cracked gas oil. The remaining contaminants are flushed away with the liquid bottom stream.

Therefore the present invention provides a simple process for producing light olefins by means of thermal cracking of a liquid hydrocarbon feed containing naphtha and/or gas oil, wherein fouling of the vaporization coil in the cracking furnace is prevented.

We claim:

1. A process of producing light olefins from a contaminated liquid hydrocarbon feed by means of thermal cracking, which process comprises the steps of (a) supplying the feed to the inlet of a membrane unit provided with a membrane, said membrane unit having a permeate side and a retentate side separated by the membrane, and removing from the permeate side a permeate and from the retentate side a retentate;

(b) supplying the permeate to the inlet of a cracking furnace, allowing the permeate to crack in the coils of the cracking furnace in the presence of steam at elevated temperature and removing from the cracking furnace a cracked stream which is enriched in light olefins;

(c) quenching the cracked stream;

(d) supplying the cooled cracked stream to a fractionation column;

(e) supplying the retentate to the fractionation column; and (f) removing from the top of the fractionation column a gaseous stream, from the side of the fractionation column a side stream of fuel oil components and from the bottom of the fractionation column a bottom stream.

* * * * *